US007487922B2

(12) United States Patent
McCabe

(10) Patent No.: US 7,487,922 B2
(45) Date of Patent: Feb. 10, 2009

(54) WINDMILL DAMPER OPERATOR

(75) Inventor: Francis J. McCabe, Ottville, PA (US)

(73) Assignee: OmniWind Energy Systems LLC, Dublin, PA (US)

( * ) Notice: Subject to any disclaimer, the term of this patent is extended or adjusted under 35 U.S.C. 154(b) by 620 days.

(21) Appl. No.: 11/173,106

(22) Filed: Jul. 1, 2005

(65) Prior Publication Data

US 2006/0006245 A1 Jan. 12, 2006

Related U.S. Application Data

(60) Provisional application No. 60/585,990, filed on Jul. 7, 2004.

(51) Int. Cl.
*F24F 7/00* (2006.01)
*B60H 1/34* (2006.01)

(52) U.S. Cl. ..... 236/49.3; 62/186; 454/152; 454/278

(58) Field of Classification Search ..... 236/49.3; 62/186; 454/341, 347, 143, 152, 275, 278; 290/44, 55, 1 C
See application file for complete search history.

(56) References Cited

U.S. PATENT DOCUMENTS

| | | | | |
|---|---|---|---|---|
| 3,806,733 | A * | 4/1974 | Haanen | 290/55 |
| 3,815,638 | A * | 6/1974 | Martin | 138/103 |
| 4,311,435 | A * | 1/1982 | Bergero | 416/170 R |
| 4,446,418 | A * | 5/1984 | Richardson | 322/4 |
| 4,501,389 | A * | 2/1985 | Kolt | 236/49.5 |
| 4,527,072 | A * | 7/1985 | van Degeer | 290/55 |
| 5,117,143 | A * | 5/1992 | Iddings | 310/191 |

FOREIGN PATENT DOCUMENTS

| | | | |
|---|---|---|---|
| JP | 55014941 | A * | 2/1980 |
| JP | 01127846 | A * | 5/1989 |

* cited by examiner

*Primary Examiner*—Marc E Norman
(74) *Attorney, Agent, or Firm*—Gregory J. Gore

(57) ABSTRACT

A small windmill is provided upstream of a damper in an air duct. When air flows in the duct it rotates the windmill. The windmill shaft is connected by a cable to the damper operator through a transmission means, such that, as the shaft turns, it takes-up the cable an opens the damper.

12 Claims, 8 Drawing Sheets

WINDMILL DAMPER OPERATOR

CROSS REFERENCE TO RELATED APPLICATION

This application is a continuation-in-part of my prior provisional application No. 60/585,990 filed Jul. 7, 2004 entitled WINDMILL DAMPER OPERATOR, the disclosure of which is incorporated herein by reference as if fully set forth.

BACKGROUND OF THE INVENTION

1. Technical Field

This invention relates to dampers, and more particularly, to mechanisms for operating various usage dampers.

2. Background

In the prior art, a multi-blade damper was positioned in an air duct. The damper could have been for fire, smoke or other air control. The damper was opened by a linkage mechanism attached to, for example, a cable, such that when the cable was pulled, the damper operated (i.e. opened).

To aid in getting the damper to operate, a motor driven fan is used upstream (or downstream) of the damper. A motorized damper operator is used for center pivoted blade dampers and for off-center pivoted blades. It is used to supply air flow in the heating, ventilating and air conditioning system. This motor operator required electrical circuitry not only to operate the center pivoted damper, but more particularly, to operate the damper synchronously with the start-up of the air flow in the air duct. If, for example, the air supply fan came on and the damper didn't open promptly, the duct could be blown apart.

In accordance with my invention, the air conditioning fan itself provides the force means to operate the damper without the need for the separate motor and circuitry.

Furthermore, in cases where the fan does not provide enough air flow power to begin the opening of the damper, it is desirable to provide a means to enhance the airflow initiating means sufficiently to start air flow to operate the damper.

SUMMARY OF THE INVENTION

In a system having a duct, an air supply means to supply air flow in said duct and a damper means operable between an opened and a closed position, positioned downstream in said air flow, I have invented a windmill operator means connected to said damper means responsive to air flow in said duct to open said damper means.

DESCRIPTION OF THE PREFERRED EMBODIMENTS OF THE INVENTION

Figure 2:
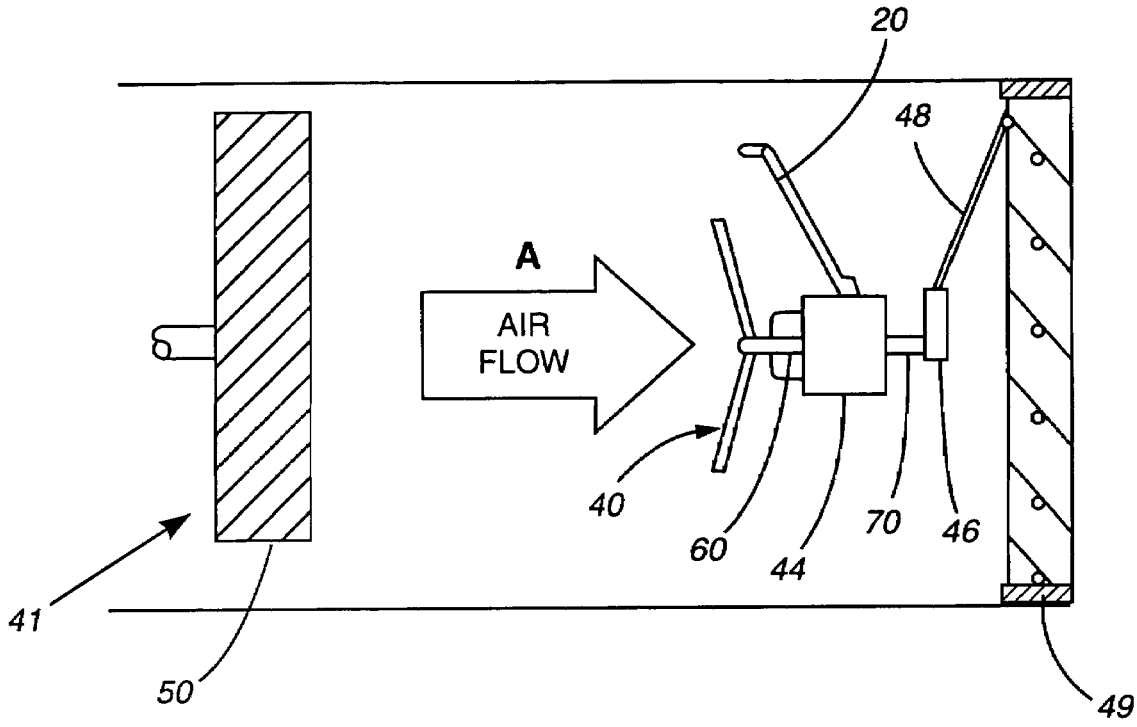
FIG. 2 is a schematic of an apparatus in accordance with my invention.

In accordance with the preferred embodiment of my invention, a system having a duct, an air supply means to supply air flow in said duct and a damper means operable between an opened and a closed position, positioned downstream in said air flow is provided with a windmill operator means connected to said damper means responsive to air flow in said duct to open said damper means. A small windmill 40 is mounted upstream of a damper 49 in the air handling duct 41 (FIG. 2). When the fan or blower 50 FIG. 2 associated with the air handling duct turns on, air is directed into the duct. The flow of air is shown by the "A" in FIG. 2. There must be some air flow in the duct to make my device work. This air flow can be provided by opening a small vent 45 in the wall 43 of the duct to gain initial air flow. This vent is provided by an access door means comprising an access door 42 in the wall 43 of the air duct.

Figure 1:
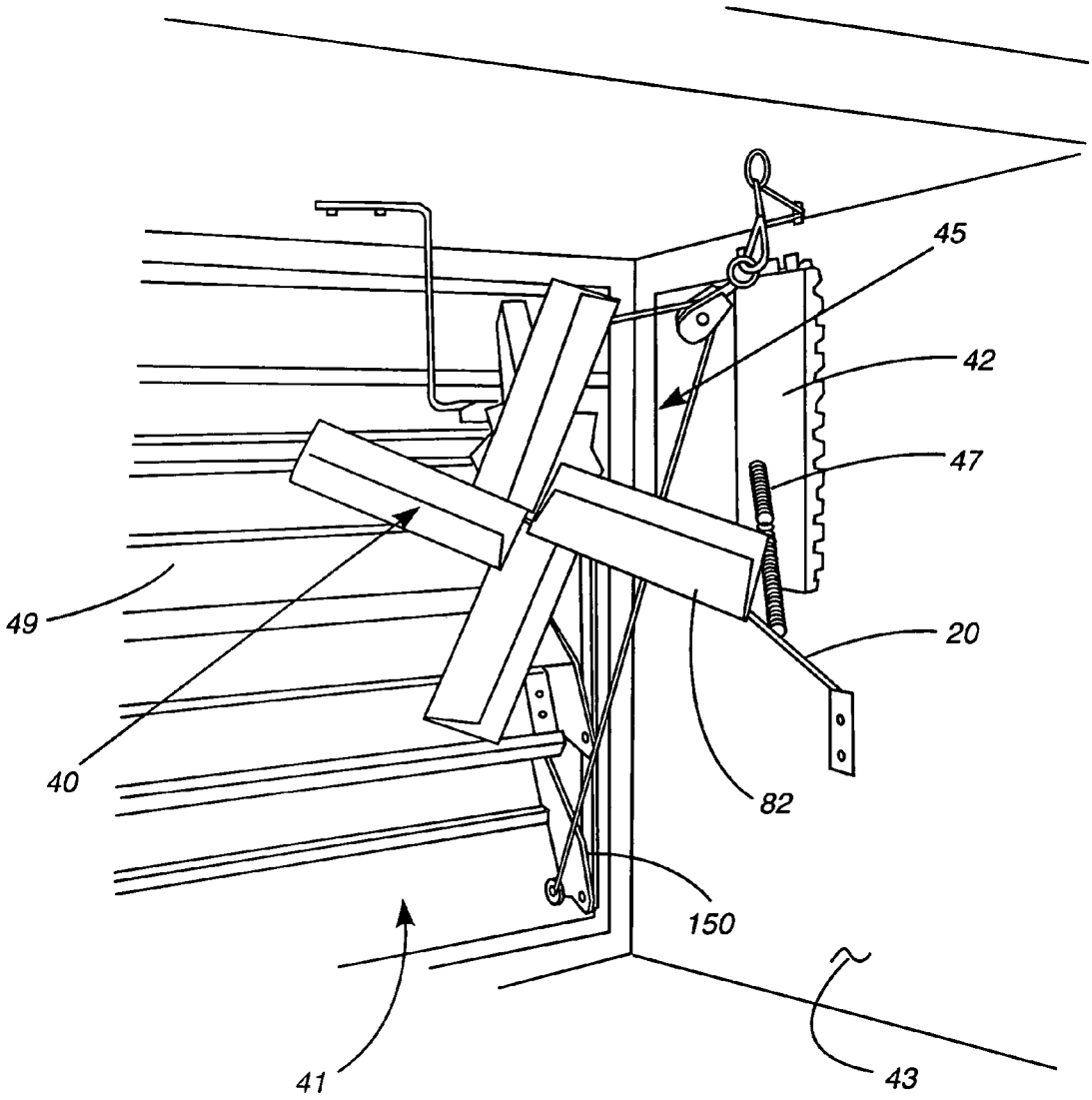
FIG. 1 is a perspective view of one embodiment of my invention.
Figure 3:
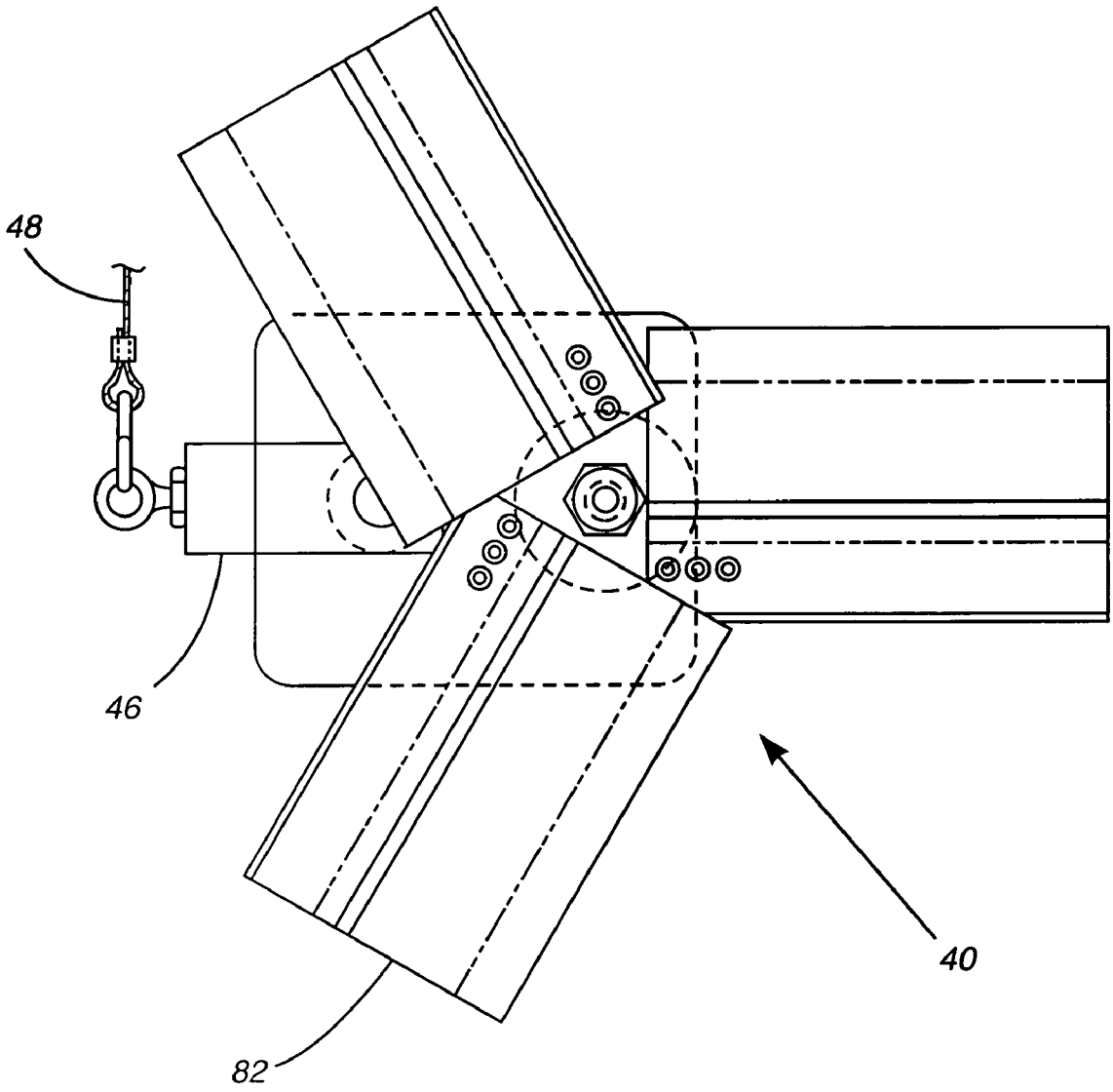
FIG. 3 is a side view taken in the direction of the arrow "A" in FIG. 2, of an apparatus in accordance with my invention.

In one embodiment, the windmill 40 FIGS. 1 to 3 is mounted to the air duct wall 43. An access door means comprising an access door 42 in the wall of the duct is mounted to be pivoted to an open position (as shown in FIG. 1) to allow air flow through the duct (designated generally 41) and out the opening designated (generally 45).

When air goes into the duct 41 and the damper 49 is closed, the pressure builds up within the duct, eventually forcing the access door 42 to open. Once the access door 42 opens, the windmill 40 starts to turn; because air is flowing through the duct and out the resulting opening 45 in the duct wall 43. Prior to that time, there is no real air flow; but rather just a build-up of pressure.

The windmill operator means further comprises a windmill means and a damper operator means connected to said damper means, comprising a cable connected at one end thereof to said damper means and at the other end thereof to a force transmission means connected to said windmill means.

Figure 9:
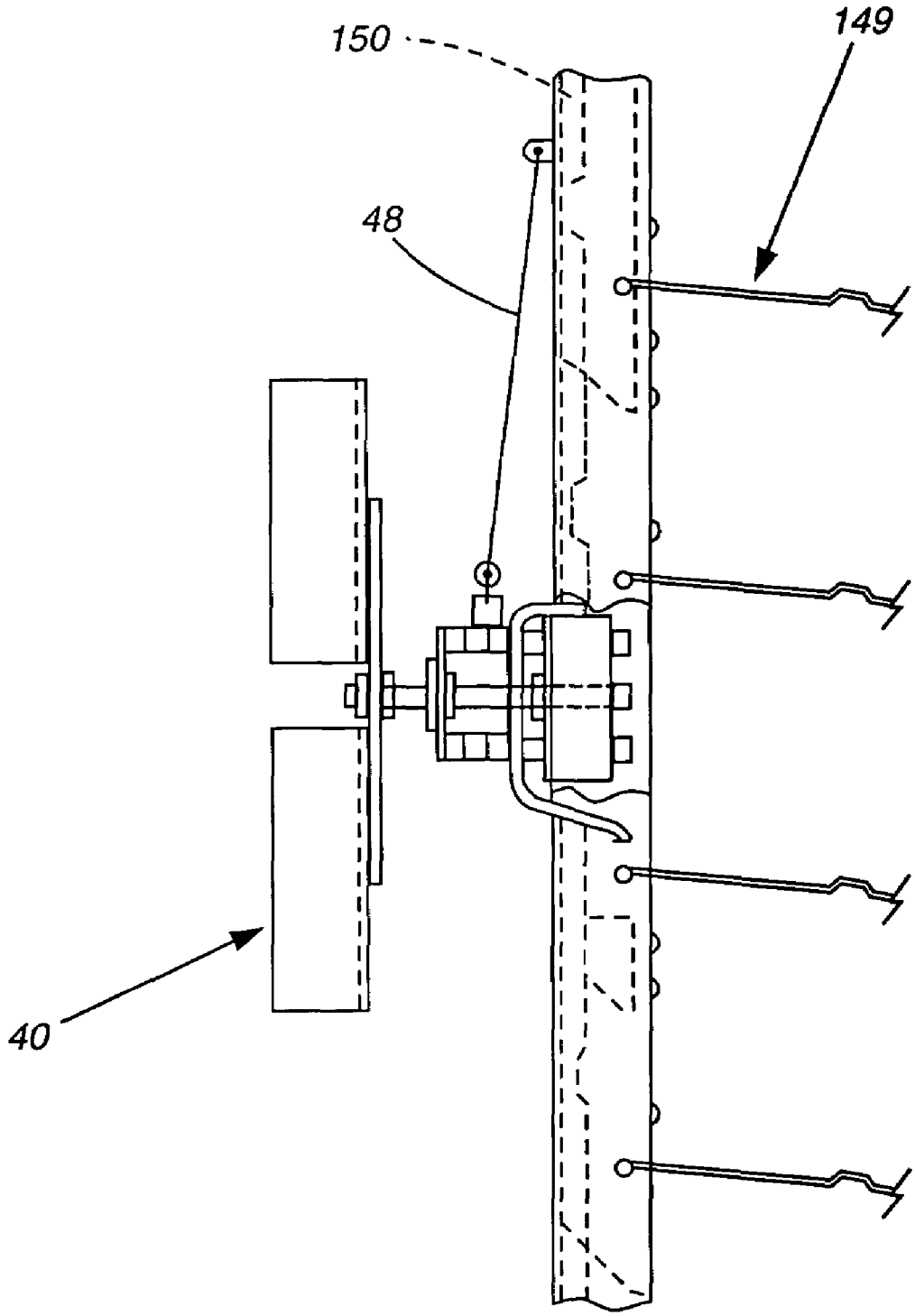
FIG. 9 is a side elevation of an alternate embodiment of my invention.

Mounted to this windmill is a small gear box 44 (FIG. 2) and a cable take-up means; which, in this embodiment, is a drive arm 46. A bracket 20 mounts the gear box 44 to the wall of the duct. A cable 48 FIGS. 2 and 3 is attached at one end to a drive arm 46 and at the other end to the damper blade actuating linkage 150 FIG. 9. The gear box 44 is used to increase the torque from the windmill to turn the drive arm. When the windmill turns, it turns the drive arm which draws up the cable 48, thereby operating the damper blade actuating linkage 150 and opening the damper.

This causes the pressure to drop in the air duct. A spring 47 (FIG. 1) attached to the bracket 20 and the access door 42 overcomes the reduced pressure in the duct and closes the access door. Now, the air flow is going through the duct, through the windmill and through the damper.

Once the damper is fully open and against its built-in stops (not shown, but well known in the art), the windmill simply stalls out and stops spinning; because it cannot overcome the damper stop force. Even though the windmill stops turning, it still provides a force to hold the damper open.

When the fan 50 is turned off, the windmill loses its power and the damper is closed, such as, for example, by a spring (not shown, but well known in the art). My drive mechanism then re-arms itself to again open the damper when the fan comes back on.

There is a particular advantage to this device with fire and smoke dampers, because such dampers are normally operated by means of electrical controls and motors. This damper opening mechanism eliminates all the electrical motors, controls and wiring and provide power off closure fail safe operation; except when the windmill is a partial power assist to an otherwise inadequate operator. It takes very little for an initial opening of the damper to provide sufficient air flow to start the windmill. I have determined that small, highly geared windmill motor blades are nearly invisible to the air flow; and will fully open the damper. An electric or pneumatic motor imposes about the same (small) air flow resistence as the wind mill.

Furthermore, the windmill can be used to supply electric or pneumatic power to a battery or air tank, respectively.

Also, it can be used for positive blade positioning to use dampers with adjustable stop and springs or weight to set up space pressurization in order to establish space to space pressure differentiation.

In another embodiment I provide a force transmission means and a disengagement means utilizing a heat responsive bimetallic mechanism means. These are shown in FIGS. 5 through 8. The windmill 40 comprises a hub 80 and blades 82 FIG. 5. The hub 80 is mounted for rotation to the shaft 60. The shaft 60 is journaled in bearings 67, 68 and 69 which are mounted on a fixed support 66 attached to the gear box 44.

Figure 8:
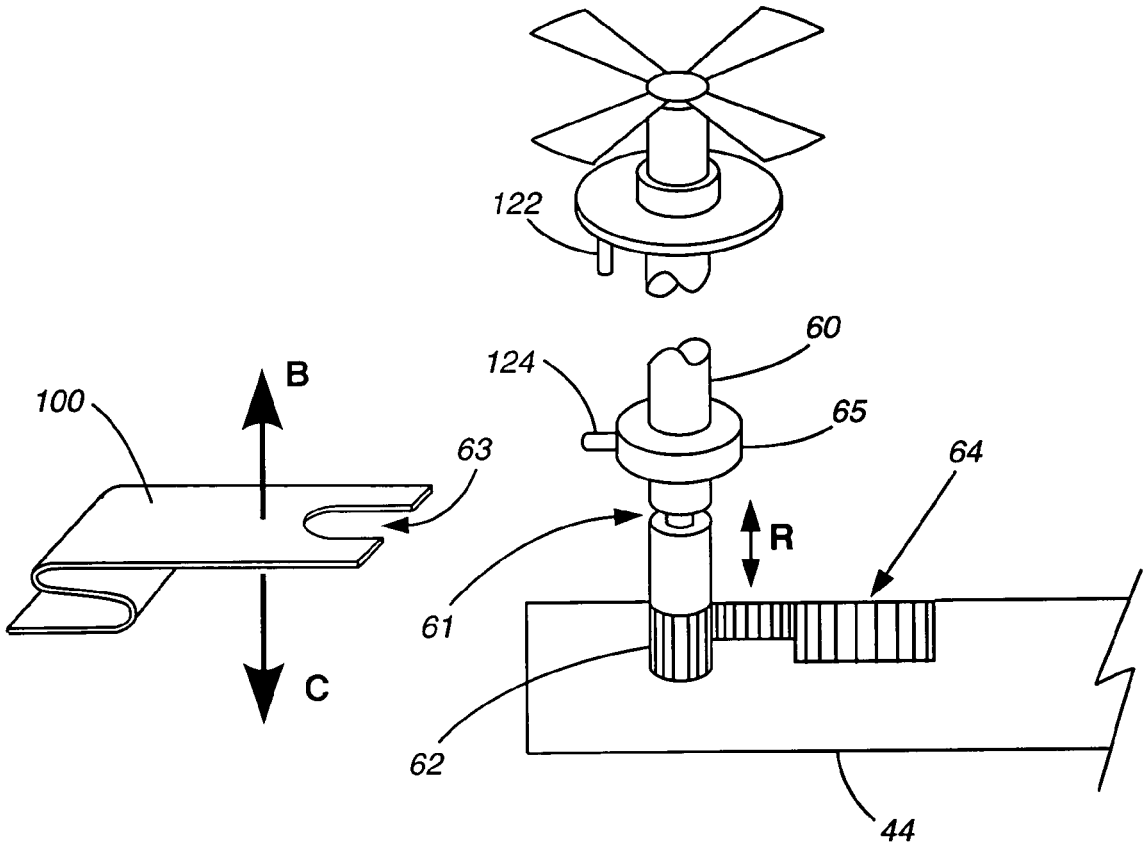
FIG. 8 is a perspective view of an alternate embodiment of my invention.

The shaft 60 has a spline gear 62 at its end; which engages a gear in the gear train 64 (having a plurality of gears) in the gear box 44 (FIG. 8). When the windmill turns, the shaft 60 turns and this turns the gears in the gear train 64.

Figure 4:
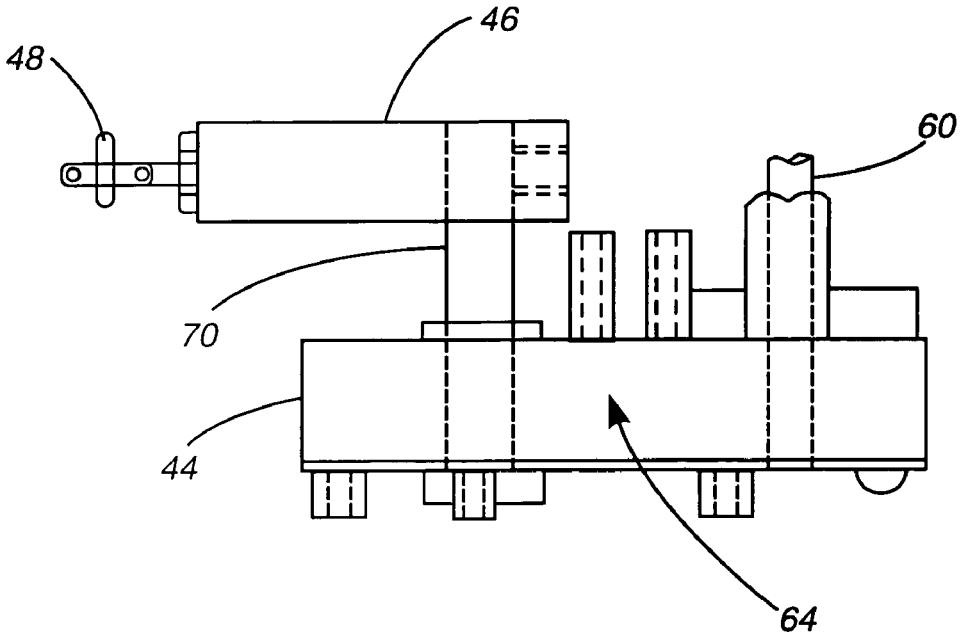
FIG. 4 is an enlarged elevation of a portion of the apparatus shown in FIG. 2.
Figure 5:
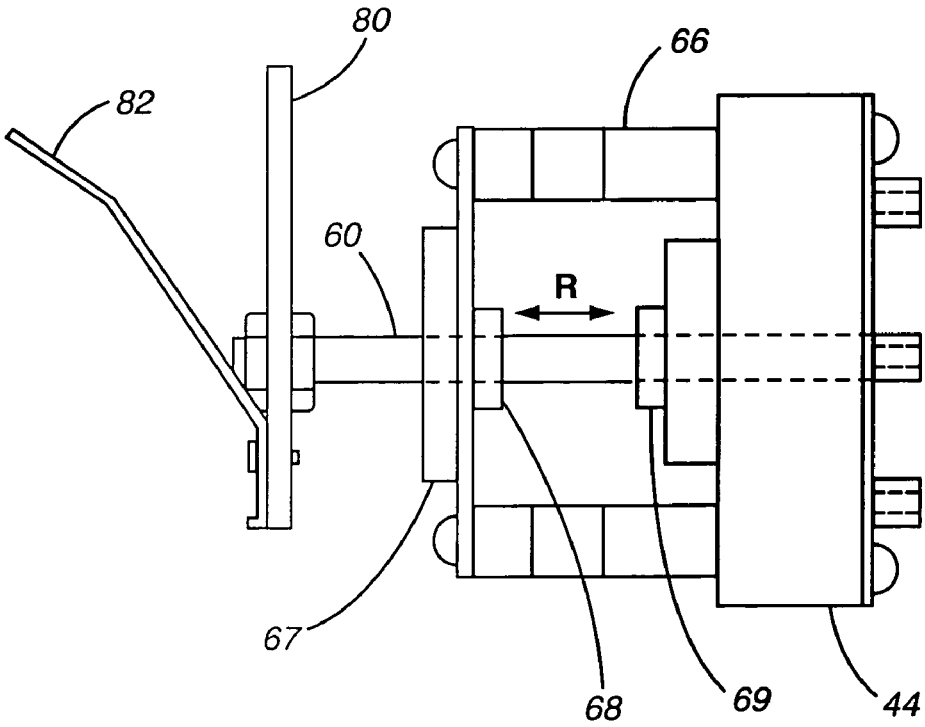
FIG. 5 is an enlarged elevation of another portion of the apparatus shown in FIG. 2.
Figure 6:
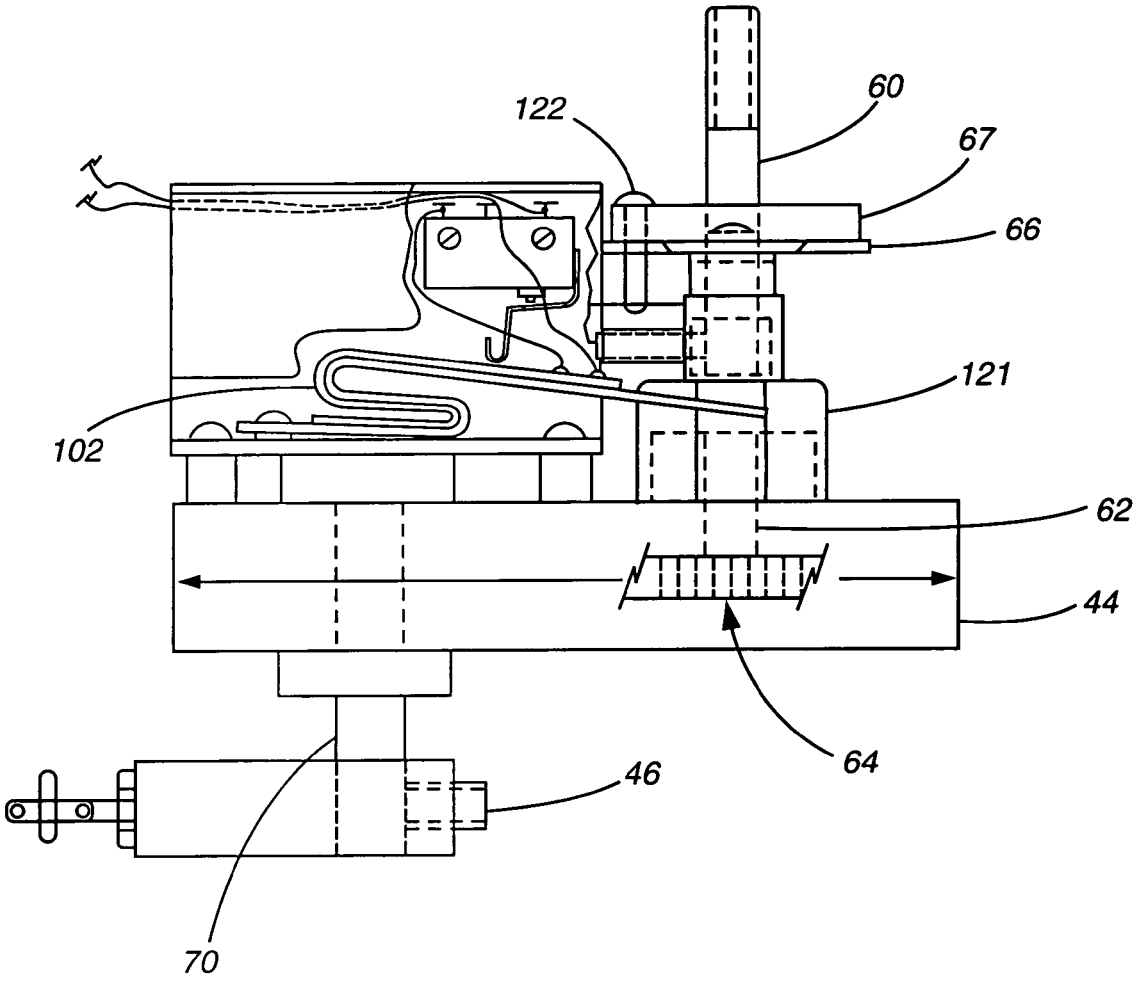
FIG. 6 is an enlarged elevation of a portion of an alternate embodiment of my invention.
Figure 7:
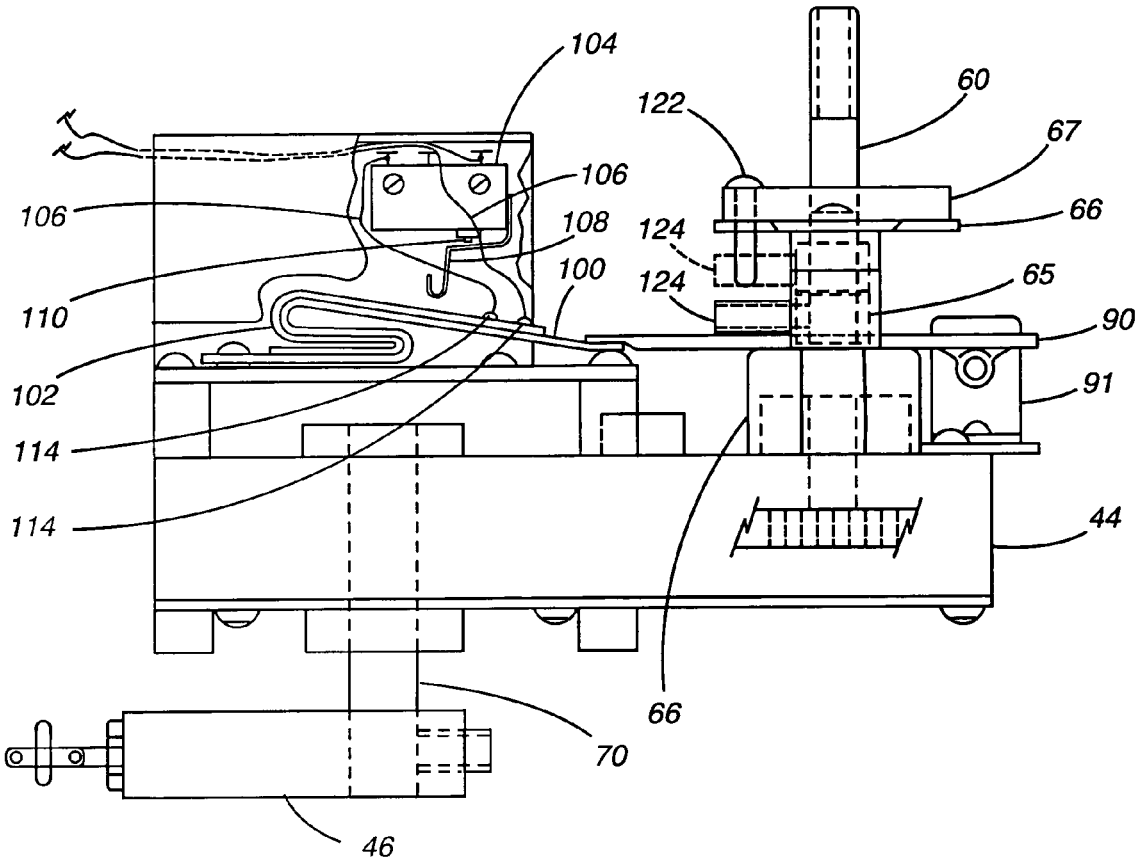
FIG. 7 is an enlarged elevation of a portion of another alternate embodiment of my invention.

The shaft 70 (FIGS. 2 and 4) also engages a gear in the gear train 64 and is, accordingly, turned as the gears move. This shaft 70 is attached to the drive arm 46 (as for example, by a set screw), so that as the shaft 70 turns, so does the drive arm 46.

The gear train 64 is a reduction gear train of most preferably in the range of 300 to 600 to one; to give the windmill a large mechanical advantage.

The force transmission means further comprises a runaway prevention means to prevent the windmill from freewheeling when the windmill shaft is disconnected from the gear, comprising a first member fixed with respect to rotation of said shaft and a second member connected to the windmill shaft and positioned so as to engage the first member and thereby interfere with rotation of the windmill shaft. The first member comprises a pin 122 which extends downwardly from the outer bearing 67 through the frame 66.

A collar 65 is fixed to the shaft 60 (FIG. 8). When the shaft 60 is raised in the direction of the arrow "B", a second member comprising a pin 124 (which extends from the collar 65) is positioned (as shown in phantom lines) so as to engage the pin 122 as the shaft 60 and collar 65 rotate. This prevents gear clashing while the windmill shaft is disengaged from the gear train; and is primarily useful for smooth re-engagement after a fire heat or detector signal ceases, for heater pad models, if the fans remain on.

To raise the shaft 60, I provide the following means. The shaft 60 is relieved at 61. A bimetallic member 100 has a yoke at its free end providing an opening designated generally 63; so that its free end can embrace the shaft in the relieved portion 61 (FIG. 8). The bi-metallic member 100 is serpentine in shape and is made of two metals laminated together. The metals have different coefficients of expansion; so that when subjected to heat, the free end moves in the direction of the arrow "B" (FIG. 8). Normally, the free end holds the shaft down. However, if there is a fire, the heat from the fire would expand the bi-metal member and it will raise upwardly in the direction of the arrow "B".

The heating of the bi-metallic element can also be accomplished by electrically heating a heating element 102 that is vulcanized onto the bimetallic member. Heat is provided through an electrical heat application means comprising a micro switch 104, wires 106 and contacts 114. This heating moves the shaft out of engagement with the gear train.

The application of heat can be terminated by an automatic termination means, comprising the micro switch 104, which can be deactivated by an arm 108 and contact 110 to disconnect the application of heat and prevent the heating element from burning up.

The pins 122 and 124 provide a run-a-way prevention means to prevent the windmill from free wheeling in the "hot" raised position.

When the heating of the bimetallic element stops and it cools down, it drives the shaft 60 down in the direction of the arrow "C" and thereby, re-engages the spline gear 62 with the gear train 64.

To provide a greater mechanical advantage for the lifting action of the bimetallic element in raising the shaft, I have provided a mechanical enhancing means comprising a lever 90 pivotally mounted to a mullion 91. The free end of the lever is positioned to lie over the free end of the bi-metal element 100. A groove in the lever, embraces the shaft 60 in the relieved portion 61. When the bi-metal is heated, it rises its free end and, thereby, raises the lever 90 and the shaft 60.

It will be understood by those of ordinary skill in the art that the air flow to operate the damper may be provided in a separate small air flow ducting means positioned between the damper and a fan or parallel with the damper.

In another embodiment, a butterfly or other air flow responsive damper, such as a back draft damper is used. The back draft type damper 149 (FIG. 9) is initially opened by air flow force from the blower 50. Here again, when the air flows in and the damper is closed, the pressure builds up; however, in this case the initial opening of the damper is caused by the air pressure. The reason for this is that the blades in a back draft damper 149 are normally pivotally mounted at their upper ends (rather than in the middle; as is the case with damper 49). As soon as either air pressure or the start-up motor opens the damper even a small amount, air flow takes over and powers up the windmill blades. The damper is further opened and held open by the windmill. A motor may also be used to hold the damper open. Therefore, the holding is no longer done by the fan air flow or electric power alone. Thus, the need for a much larger fan motor is eliminated.

Another version positions the windmill gear box arrangement of the first embodiment outside the air duct, in a duct of its own, which is vented, so that when the air flow comes on, the air passes through the smaller duct; turns the windmill; and then the windmill opens the damper. This conduiting of a small separate air flow can be independent of the dampered positive or negative air flow source.

A very small, low power damper start-up motor may be used.

If a pulley is used as the take-up means, in stead of a drive arm 46, the gear train reduces the turning of the pulley to approximately one RPM.

What is claimed is:

1. In a system having a duct, an air supply means to supply air flow in said duct and a damper means operable between an opened and a closed position, positioned downstream of a windmill means in said airflow, comprising:

electrical windmill operator means connected to said damper means by a direct mechanical linkage forcibly responsive to air flow in said duct and said windmill means to open said damper means.

2. The device of claim 1 further comprising an access door means in said duct moveable between an open and a resiliently biased closed position, responsive to air pressure in said duct to move said door to an open position and permit air flow out of said door only when said damper is substantially in the closed position.

3. The device of claim 2 further comprising the windmill means and a damper operator means connected to said damper means, comprising a cable connected at one end thereof to said damper means and at the other end thereof to a cable take-up means connected to said windmill means.

4. The device of claim 3 wherein said cable take-up means further comprises a gear box means that includes a gear train having a plurality of gears;

and said windmill means further comprises a windmill having a windmill shaft being rotatable upon rotation of said windmill; said shaft engaging at least one of said gears to rotate said gear.

5. The device of claim 4 wherein the cable take-up means is connected to a gear in said gear box biased to high ratio to minimize windmill size and minimize energy take-up;

means to rotate therewith upon rotation of said windmill shall;

and said cable is connected to said cable take-up means, whereby said cable is taken-up upon rotation of said windmill to open said damper.

6. The device of claim 4 further comprises disengagement means juxtaposed to said windmill shaft to selectively engage said windmill shaft and move it to a position disconnected from the gear in the gear box means.

7. The device of claim 6 wherein the disengagement means further comprises a heat responsive bimetallic mechanism means, moveable upon the application of heat thereto to engage said shaft and move it.

8. The device of claim 7 wherein heat is applied by an electrical heat application means.

9. The device of claim 8 further comprising a termination means to automatically disconnect the application of heat while holding the shaft in the disengaged position.

10. The device of claim 6 further comprising a run-away prevention means to prevent the windmill from free-wheeling when the windmill shaft is disconnected from the gear, comprising a first member fixed with respect to rotation of said shaft and a second member connected to the windmill shaft and positioned so as to engage the first member and thereby interfere with rotation of the windmill shaft thereby, and preventing damage to said gear box.

11. The device of claim 1 wherein said windmill means operates the opening of said damper such that the windmill means stalls when said damper means is in a fully opened position.

12. The device of claim 11 wherein said damper means is resiliently biased to the closed position when either mechanically released or upon reduced air flow in system (duct).

* * * * *